United States Patent [19]

Tabata

[11] Patent Number: 4,656,850

[45] Date of Patent: Apr. 14, 1987

[54] ELECTRIC LOCK

[75] Inventor: Hiroshi Tabata, Mie, Japan

[73] Assignee: Miwa Lock Mfg. Co., Ltd., Watarai, Japan

[21] Appl. No.: 683,320

[22] Filed: Dec. 18, 1984

[30] Foreign Application Priority Data

Dec. 19, 1983 [JP] Japan ..... 58-239294

[51] Int. Cl.[4] ..... E05B 47/06

[52] U.S. Cl. ..... 70/276; 70/282; 70/283; 70/380; 292/144; 292/169.15; 292/336.5; 292/DIG. 27; 335/230; 361/171

[58] Field of Search ..... 70/283, 282, 277, 279, 70/276, 271, 218, 379 R, 379 A, 380; 361/171, 172; 340/825.31; 335/229, 230; 292/251.5, 144, 201, DIG. 27, 169.15, 336.5

[56] References Cited

U.S. PATENT DOCUMENTS

| | | | |
|---|---|---|---|
| 1,124,666 | 1/1915 | Schutzmann | 70/283 |
| 1,128,392 | 2/1915 | Van Winkle | 70/282 |
| 1,990,352 | 2/1935 | Singleton | 70/283 |
| 4,167,104 | 9/1979 | Bond | 70/282 X |

FOREIGN PATENT DOCUMENTS

| | | | |
|---|---|---|---|
| 3206687 | 10/1983 | Fed. Rep. of Germany | 70/276 |
| 2460533 | 2/1981 | France | 70/276 |
| 50292 | 11/1980 | Japan . | |
| 19656 | 5/1981 | Japan . | |
| 1308145 | 2/1973 | United Kingdom | 70/276 |

*Primary Examiner*—Gary L. Smith
*Assistant Examiner*—Lloyd A. Gall
*Attorney, Agent, or Firm*—Spencer & Frank

[57] ABSTRACT

An electric lock comprising a solenoid which has a permanent magnet for attracting a plunger and an electromagnetic coil which is positioned adjacent the permanent magnet so as to control the magnetic flux of the permanent magnet. A cam member which has a cam surface formed at one end thereof engages an engaging pin when a bolt operating member is rotated so as to lock the electric lock so that an engaging rod is forced to move in the direction opposite to the direction in which an engaging bolt is biased, the other end of the engaging rod being connected to the plunger of the solenoid. A positive voltage application unit responds to an unlocking signal so as to temporarily cause a current to flow through the electromagnetic coil in such a way that the flux produced by the electromagnetic coil cancels the magnetic flux produced by the permanent magnet.

16 Claims, 14 Drawing Figures

ELECTRIC LOCK

BACKGROUND OF THE INVENTION

The present invention relates to an electric lock which is unlocked electrically and more particularly to an electric lock whose electric power consumption is very small.

In the cases of conventional electric locks, a magnetic card reader reads information which is magnetically recorded on a magnetic card, as is well known in the art, and whether an electric lock is to be unlocked or not is determined by comparing the information read out of the magnetic card with reference information inherent to each room. When the electric lock is to be unlocked, an electric actuator such as an electromagnetic solenoid or a micromotor is energized in response to an electrical unlocking signal so that a dead bolt or the like is displaced in the direction in which the electric lock is unlocked or a strike on the side of a door frame which is made into engagement with the dead bolt or the like is released, whereby the electric lock is unlocked.

As described above, in the conventional electric locks, a locking member or mechanism is directly actuated by an electric actuator and naturally has inertial and the frictional resistance. Therefore, in order to assure the positive unlocking operation of the electric lock, a considerable amount of electric power must be supplied to the electric actuator. As a result, it is impossible in practice to supply electric power from a battery power supply because of rapid power consumption of a battery. Therefore power supply lines must be arranged for electric locks.

As compared with mechanical locks such as tumbler locks, it is difficult to illegally unlock an electric lock so that electric locks are highly reliable with regard to safety. Therefore, electric locks are very suitable as locks of rooms of hotels or the like where various persons visit. Another advantage of electric locks resides in the fact that when they are installed in hotels or the like, the electric locks of all guest rooms can be simultaneously unlocked from a front office of the hotel in case of an emergency such as fire or earthquake. However, as described above, the electric power consumption of conventional electric locks is relatively high so that a power supply with a high capacity, which is not necessary except in the case of an emergency, must be installed in order to simultaneously unlock all the electric locks of all guest rooms.

SUMMARY OF THE INVENTION

In view of the above, one of the objects of the present invention is to provide an electric lock which consumes less electric power and which, therefore, can substantially overcome the above and other problems encountered with conventional electric locks.

To the above and other ends, the present invention provides an electric lock comprising an actuator which is rotatably supported by a lock box, integrally joined to an outer unlocking member and has a recess formed at the outer peripheral surface thereof; a bolt operating member rotatably fitted over the actuator; an engaging rod which is guided in the direction perpendicular to the axis of rotation of the actuator by the bolt operating member and which has an engaging pin extended from one end thereof which in turn is extended beyond the bolt operating member, and which is biased in the direction in which the other end thereof engages with said recess of the actuator; a solenoid which has a permanent magnet for attracting a plunger and electromagnetic coil which is connected to the permanent magnet so as to control the magnetic flux of the permanent magnet; a cam member which has a cam surface formed at one end thereof which engages with the engaging pin when the bolt operating member is rotated so as to lock the electric lock so that the engaging rod is forced to move in the direction opposite to the direction in which the engaging bolt is biased, and whose other end is connected to the plunger of the solenoid; and a positive voltage application unit which responds to an unlocking signal so as to temporarily cause a current to flow through the electromagnetic coil in such a way that the flux produced by the electromagnetic coil cancels the magnetic flux produced by the permanent magnet.

The present invention further provides an electric lock characterized by comprising an actuator which is rotatably supported by a lock box, integrally joined to an outer unlocking member and has a recess formed at the outer peripheral surface thereof; a bolt operating member rotatably fitted over the actuator; an engaging rod which is guided in the direction perpendicular to the axis of rotation of the actuator by the bolt operating member and which has an engaging pin extended from one end thereof which in turn is extended beyond the bolt operating member, and which is biased in the direction in which the other end thereof engages with the recess of the actuator; a solenoid which has a permanent magnet for attracting a plunger and an electromagnetic coil which is connected to the permanent magnet so as to control the magnetic flux of the permanent magnet; a cam member which has a cam surface formed at one end thereof which engages with the engaging pin when the bolt operating member is rotated so as to lock the electric lock so that the engaging rod is forced to move in the direction opposite to the direction in which the engaging bolt is biased, and whose other end is connected to the plunger of the solenoid; a positive voltage application unit which responds to an unlocking signal so as to temporarily cause a current to flow through the electromagnetic coil in such a way that the flux produced by the electromagnetic coil cancels the magnetic flux produced by the permanent magnet; and a reverse voltage application unit for temporarily causing a current to flow through the electromagnetic coil in such a way that the direction of magnetic flux produced by the electromagnetic coil is the same as the direction of magnetic flux produced by the permanent magnet when the bolt operating member is not operated within a predetermined time interval after the unlocking signal has been generated.

The above and other objects, effects, features and advantages of the present invention will become more apparent from the following description of preferred embodiments thereof taken in conjunction with the accompanying drawings.

BRIEF DESCRIPTION OF THE DRAWINGS:

Same reference numerals are used to designate similar parts throughout the figures.

DESCRIPTION OF THE PREFERRED EMBODIMENTS

First Embodiment, FIGS. 1–6

Figure 1:
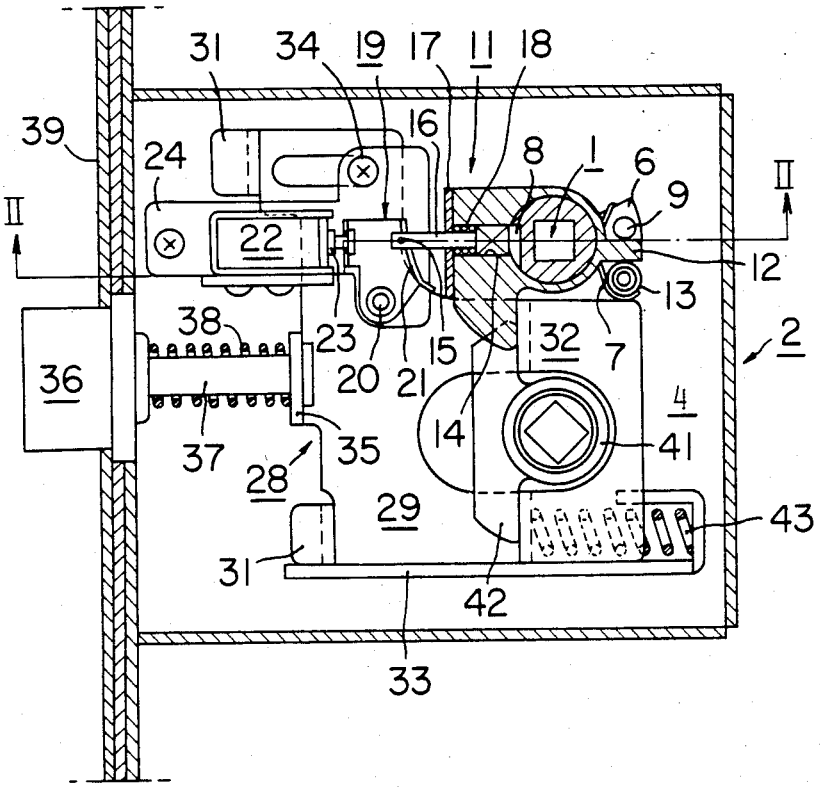
FIG. 1 is a top view, partly in section, of an electric lock of a first embodiment of the present invention.
Figure 2:
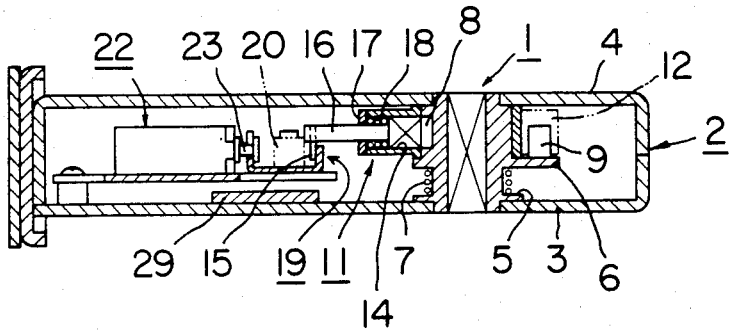
FIG. 2 is a sectional view taken along the line II—II of FIG. 1.

Referring first to FIGS. 1 and 2, an electric lock in accordance with the present invention has an actuator 1 in the form of a cylinder which has a polygonal (square in the first embodiment) hole whose axis coincides with the axis of the cylindrical actuator 1. As best shown in FIG. 2, the actuator 1 is rotatably supported by a first side plate 3 and a second side plate 4 of a lock box 2 and has a first flange 5 for engagement with the first side plate 3 of the lock box 2 and a second flange 6 extended radially outwardly from a point intermediate the ends of the actuator 1. A coiled actuator spring 7 is fitted over the actuator 1 between the first and second flanges 5 and 6. A recess 8 is formed in the outer cylindrical wall of the actuator 1 between the second flange 6 and the second side plate 4 of the lock box 2. A portion of the second flange 6 is further extended radially outwardly and has a first stopper pin 9 which is securely fixed by caulking or the like.

A bolt operating member 11 is rotatably fitted over the actuator 1 between the second flange 6 thereof and the second side plate 4 of the lock box 2. The bolt operating member 11, which is in the form of an L-shaped disk and a hook-shaped operating end formed at one end of the bolt operating member 11, is in engagement with a latch bolt slider 29 to be described below. An engaging arm 12 is formed integral with the bolt operating member 11 at the other end thererof and is extended radially outwardly. One end of the actuator spring 7 is brought into engagement with a second stopper pin 13 extended from the lock box while the other end thereof is brought into engagement with the first extended portion of the flange 6. Therefore the first stopper pin 9 is pressed against the second stopper pin 13 through the engaging arm 12, whereby the normal or initial positions of the actuator 1 and the bolt operating member 11 are defined.

The bolt operating member 11 is formed with a guide hole 14 whose axis is perpendicular to that of the actuator 1 and the inner end of the guide hole 14 is normally in opposed relationship with the recess 8.

An engaging rod 16 which has an engaging pin 15 extended from one end (the left end in FIGS. 1 and 2) and a polygonal large head portion formed integral with the engaging rod 16 at the other end thereof is axially slidably fitted into the guide hole 14. In the first embodiment, the engaging pin 15 is extended in parallel with the axis of the actuator 1 toward the first side plate 3 of the lock box 2.

A pressure plate 17 which is formed with an opening through which is slidably extended the engaging rod 16 is attached with screws or the like to the side surface of the bolt operating member 11 at which is opened the guide hole 14. A compression bias spring 18 is fitted over the engaging rod 16 between the head thereof and the pressure plate 17 so that the engaging rod 16 is normally biased in the direction in which the engaging rod 16 engages with the recess 8.

The engaging pin 15 of the engaging rod 16 is normally in engagement with a cam member 19.

As shown in FIGS. 1 and 2, the cam member 19 has a U-shaped cross sectional configuration and one end of the cam member 19 is arcuated so as to define a cam surface 21. An annular groove formed at the head of a plunger 23 of a solenoid 22 is brought into free engagement with a notch formed at the other end of the cam member 19. The cam member 19 is mounted with a pivot pin 20 on a solenoid mount 24 in such a way that the cam surface 21 may swing in the direction in which the plunger 23 moves.

Figure 3:
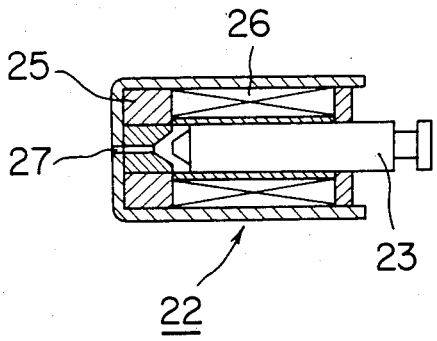
FIG. 3 is a sectional view, on enlarged scale, of a solenoid.

As shown in FIG. 3, the solenoid 22 has a permanent magnet 25 which exerts a magnetic force, for instance, in the axial direction of the plunger 23 and an electromagnetic coil 26 which is adjacent to the permanent magnet 25 and is magnetized in the axial direction of the plunger 23 when energized. Therefore the solenoid 22 is a so-called monostable electromagnet in which the plunger 23 is attracted by the permanent magnet 25 when the electromagnetic coil 26 is deenergized. The solenoid 22 is mounted on the solenoid mount 24 which in turn is securely mounted on the first side plate 3 of the lock box 2. The solenoid 22 has an air vent hole 27 so that the plunger guide bore is communicated with the surrounding atmosphere and consequently smooth movememt of the plunger 23 may be ensured. The magnetic attractive force of the permanent magnet 25 and the coil 26 when the latter is energized is determined as will be described below.

The major arrangement described above of the first embodiment of the present invention controls a latch bolt which functions as a so-called dead bolt or a locking member. The electric lock of the first embodiment shown in FIG. 1 has a latch bolt operating mechanism 28 as in the cases of conventional lock devices. Since the latch bolt operating mechanism 28 does not constitute the present invention, it will be briefly described. The latch bolt operating mechanism 28 has a latch bolt slider 29 which has a pair of first L-shaped bent portions 31 at one end (the left end in FIG. 1) and a second end portion 32 at the other end. The lower edge of the latch bolt slider 29 is brought into slidable engagement with a guide plate 33 which in turn is securely mounted in the lock box 2 and a first guide pin 34 is slidably fitted into an elongated slot formed in the latch bolt slider 29 adjacent its upper side. Therefore, the latch bolt slider 29 is guided to move horizontally to the left or right in FIG. 1. The heights of the bent portions 31 and 32 are so determined that when the latch bolt slider 29 is displaced, its intermediate portion slides along the first side plate 3 and the upper surfaces of the first and second bent portions 31 and 32 slide over the second side plate 4. Therefore the movement and inclination in the direction perpendicular to FIG. 1 are restricted.

A latch bolt supporting member 35 is formed integral with the latch bolt slider 29 at the center of one end thereof. A latch bolt 37 which has an inclined surface cam 36 at the outer end thereof is slidably fitted into the latch bolt supporting member 35. A compression latch bolt spring 38 is fitted over the latch bolt 37 so that the latch bolt 37 is biased to extend through a front panel 39, but since a flange formed at the inner end of the latch bolt 37 engages with the latch bolt supporting member 35 the latch bolt 37 is normally maintained at a position as shown in FIG. 1.

A latch bolt operating shaft 41 which has a polygonal (square in the first embodiment) shaft hole and which is extended through a large elongated slot formed through the latch bolt slider 29 at the other end thereof is rotatably supported by the lock box 2. A latch bolt operating cam 42 which is formed integral with the latch bolt operating shaft 41 rides on the stepped portion of the second bent portions 32 which are vertically spaced apart from each other. The hook-shaped operating end of the bolt operating member 11 is also brought into engagement with the stepped portion of the second bent portions 32.

The inner end of the guide plate 33 is bent in the form of U and a compression slider spring 43 is loaded between the bent portion of the guide plate 33 and the stepped portion of the second bent portions 32 so that the latch bolt slider 29 is normally biased to the left in FIG. 1, but the latch bolt slider 29 engages with the latch bolt operating cam 42 and the second guide pin 34 so that the latch bolt slider 29 remains in a position as shown in FIG. 1.

The electric lock with the above-described construction is inserted into a lock box hole formed at the free end side of a door in such a way that the first side plate 3 of the lock box 2 faces outward and is securely held in position with bolts or the like.

A first bolt operating rod (not shown) having a polygonal cross sectional configuration is inserted into the square hole of the actuator 1 in such a way that the first bolt operating rod is extended only outwardly and an outer unlocking member in the form of a knob (not shown) is attached to the extended portion of the first bolt operating rod. A second bolt operating rod (not shown) is inserted into the square hole of the latch bolt operating shaft 41 and extended inwardly of the door. A knob (not shown) is attached to the inwardly extended portion of the second bolt operating rod.

FIG. 1 shows that the electric lock is locked. In this case, the inclined surface cam 36 of the latch bolt 37 is extended through the front panel 39 and engages with a strike hole of a door frame. The bolt operating member 11 is maintained in a position as shown in FIG. 1 and 2 in a stable manner under the force of the actuator spring 7.

The coil 26 of the solenoid 22 (See FIG. 3) is not energized so that the plunger 23 is attracted only by the permanent magnet 25 and remains in a position as shown in FIG. 3. The permanent magnet 25 attracts the engaging rod 16 through the plunger 23, the cam member 19 and the engaging pin 15 so that the engaging rod 16 is disengaged from the recess 8 as shown in FIG. 1 against the bias spring 18.

Under the conditions as shown in FIG. 1; that is, when the electric lock is locked, if the knob (not shown) attached to the latch bolt operating shaft 41 is rotated in the clockwise or counterclockwise direction, the latch bolt operating cam 42 is caused to swing so that the latch bolt is operated to open the door.

However, the engaging rod 16 is disengaged from the recess 8 of the actuator 1 under the attractive force of the permanent magnet 25 of the solenoid 22. Therefore when the knob on the side of the outer surface of the door is rotated in the clockwise direction, the actuator 1 is rotated in the counterclockwise direction perpendicular to FIG. 1. On the other hand, when the knob is rotated in the counterclockwise direction, the actuator 1 is caused to engage with the second stopper 13 through the first stopper pin 9 and the engaging arm 12.

Figure 4:
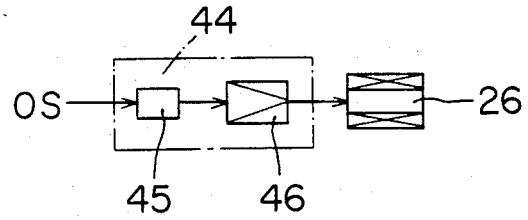
FIG. 4 is a block diagram of a positive voltage application unit.

When a key such as a magnetic card is inserted into a card reader in order to unlock the electric lock, an information processing unit generates an unlocking signal OS. Then, as shown in FIG. 4, the unlocking signal OS is applied through a positive voltage application unit 44 to the coil 26. The positive voltage application unit 44 comprises a first monostable multivibrator 45 and a first amplifier 46 which supplies electric power to the coil 26 in such a way that the magnetic flux of the permanent magnet 25 may be cancelled.

Figure 5:
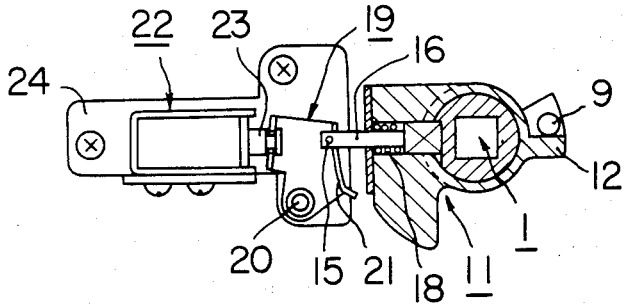
FIG. 5 is a top view, partly in section, illustrating only major parts when the electric lock as shown in FIG. 1 is unlocked.

When the unlocking signal OS is generated in the manner described above, the coil 26 is temporarily energized so that the magnetic force exerted by the permanent magnet 25 (See FIG. 3) of the solenoid 22 is opposed by the magnetic force exerted by the coil 26. As a result, the engaging rod 16 is released and is moved in unison with the plunger 23 toward the actuator 1 while swinging the cam member 19 which is engaged with the engaging rod 16 through the engaging pin 15. Then, the head at the other end of the engaging rod 16 engages with the recess 8 of the actuator 1 so that the actuator 1 and the bolt operating member 11 are interconnected to each other through the engaging rod 16. The energization time period of the coil 26 which is energized by the positive voltage application unit 44 (See FIG. 4) is equal to the output pulse spacing of the output pulse generated by the first monostable multivibrator 45 and according to the results of experiments conducted by the inventors, the coil energization time period is found to be very short and is of the order of ms (milliseconds). After the instantaneous operation of the positive voltage application unit 44, the attractive force of the permanent magnet 25 is no longer opposed. In this case, when the attracting force of the permanent magnet 25 is so selected as to be weaker than the bias force exerted on the engaging rod 16, the engaging rod 16 is maintained in a stable position as shown in FIG. 5.

Figure 6:
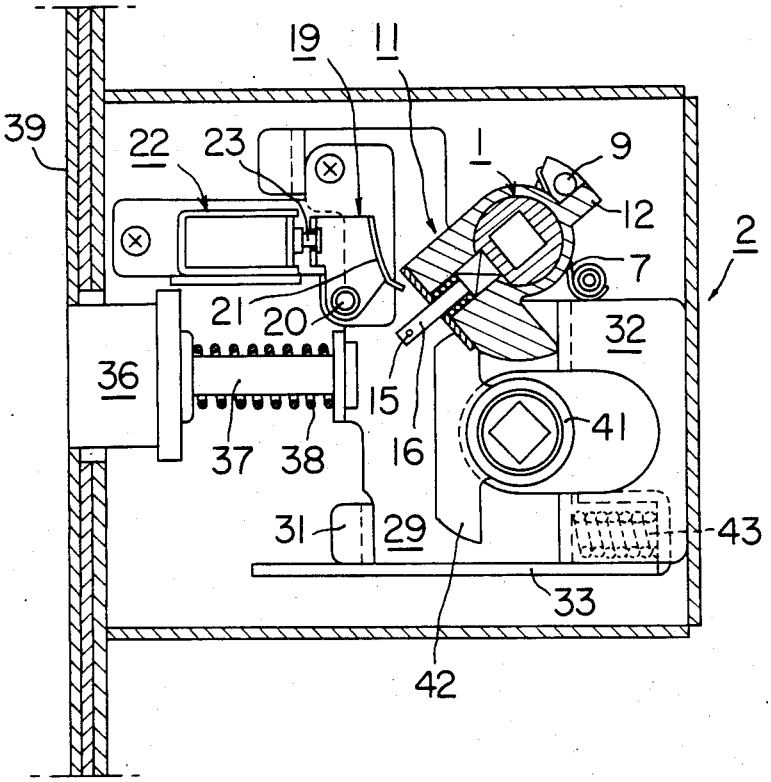
FIG. 6 is a view similar to FIG. 1 but illustrates that the electric lock is unlocked.

When the knob is rotated in the clockwise direction under these conditions, the bolt operating member 11 is caused to rotate in the counterclockwise direction as shown in FIG. 6 so that the latch bolt slider 29 is shifted to the right. As a result, the latch bolt is pulled out of the bolt hole of the door frame so that the door may be opened. In this case, the cam member 19 is returned to the locking position as shown in FIG. 6 under the force of the permanent magnet 25.

When one lets go of the knob, the latch bolt slider 29 is returned to the initial position under the force of the slider spring 43 so that the inclined surface cam 36 of the latch bolt 37 is extended beyond the front panel 39 and the bolt operating member 11 is caused to rotate in the clockwise direction under the force of the actuator spring 7 as shown in FIG. 6. As a consequence, the engaging pin 15 of the engaging rod 16 engages with the cam surface 21 of the cam member 19 and the engaging rod 16 is caused to move out of the recess 8 of the actuator 1 under the wedge action of the cam surface 21 so that the electric lock is locked automatically as shown in FIG. 1. In this case, the plunger 23 is in the position very close to the permanent magnet 25 so that the permanent magnet 25 exerts the strongest attracting force on the plunger 23. Therefore the plunger 23 is prevented from being extended out of the solenoid 22 under the force of the bias spring 18.

When the door is closed under these conditions, the inclined surface cam 36 of the latch bolt 37 is pushed into the lock box 2 by a strike plate of the door frame and the latch bolt 37 is moved inwardly relative to the latch bolt slider 29, which is located at the position shown in FIG. 1, against the latch bolt spring 38. As a result, the door is closed. When the inclined surface cam 36 is aligned with the bolt hole, the cam 36 is extended to engage with the bolt hole.

Second Embodiment, FIGS. 7–11

A second embodiment of the present invention is substantially similar in construction to the first embodiment described above with reference to FIGS. 1–6 mainly except that the dead bolt 47 is controlled independently of the latch bolt.

Figure 7:
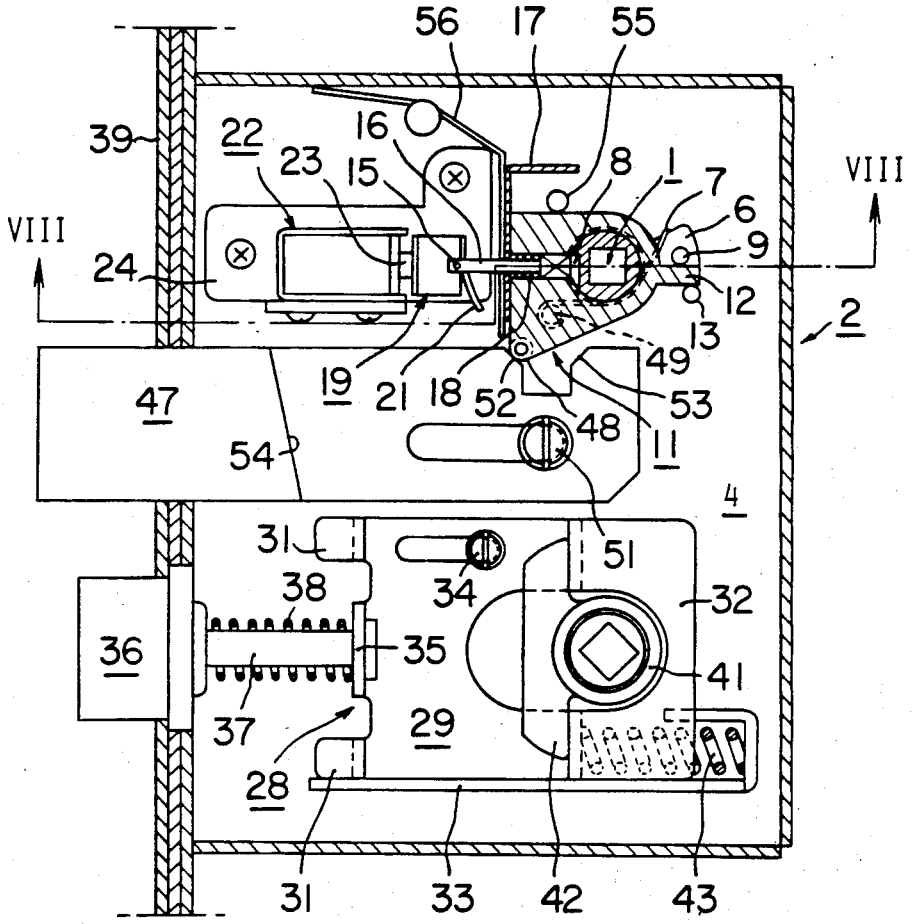
FIG. 7 is a top view, partly in section, of a second embodiment of the present invention.

The bolt operating member 11 of the second embodiment is in the form of a bell-shaped disk as shown in FIG. 7. A dead bolt engaging pin 48 is extended perpendicularly from one end of the bolt operating member toward the first side plate 3 and a spring bearing or shoe 49 is extended also perpendicularly from the inner surface of the first side plate 3. One end of the actuator spring 7 is engaged with the spring pin 49 while the other end thereof is engaged with the extended portion of the flange 6 so that the first stopper pin 9 is forced to engage with the engaging arm 12, whereby the relative angular position of the actuator 1 with respect to the bolt operating member 11 is defined.

The dead bolt 47 is guided in the direction perpendicular to the front panel 39 by means of an opening formed through the front panel 39 and a second guide pin 51. The dead bolt 47 has a notch formed at one side adjacent to the inner end thereof and the notch defines a first and a second striking surface 52 and 53. The engaging pin 48 engages with this notch to move the dead bolt 47.

Figure 8:
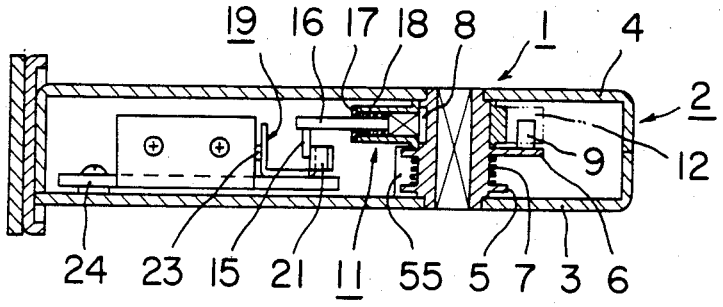
FIG. 8 is a sectional view taken along the line VIII—VIII of FIG. 7.

The cam member 19 which engages with the engaging pin 15 of the engaging rod is securely joined to the head of the plunger 23 by caulking or the like and is guided by the plunger 23 and the solenoid mount 24 so as to move in a straight line in unison with the plunger 23 (See FIG. 8).

The thickness of the dead bolt 47 is reduced as indicated by a step 54 in FIG. 7 in order to prevent the interference with bolt operating member 11. A third stopper pin 55 is extended from the first side plate 3 so as to limit the angle of rotation of the actuator 1. A snap spring 56 is loaded so that when the electric lock is locked or unlocked, the bolt operating member 11 remains at a predetermined position and the snap spring 56 imparts the snap action to the bolt operating member 11.

A dead bolt operating rod which extends through a door in the direction of thickness thereof and which has a square cross sectional configuration is inserted into the square hole of the actuator 1 and a knob (not shown) is attached to one end of the dead bolt operating rod extended beyond the door outwardly while an unlocking member such as a thumb-turn or the like (not shown) is securely attached to the other end of the dead bolt operating rod extended beyond the door inwardly.

In like manner, a square latch bolt operating rod (not shown) is inserted into the square hole of the latch bolt operating shaft 41 and knobs (not shown) are securely attached to both ends of the latch bolt operating rod.

FIG. 7 shows that the electric lock is closed or locked. In this case, the dead bolt 47 is extended beyond the front panel 39 and engages with a strike hole of a door frame and the bolt operating member 11 remains in the position shown in FIG. 7 in a stable manner under the force of the snap spring 56. One component of the force which tends to push back the dead bolt 47 is received by the actuator 1 through the first striking surface 52, the dead bolt engaging pin 48 and the bolt operating member 11.

When the outer knob which is connected to the actuator 1 is rotated in the clockwise direction (in the counterclockwise direction in FIG. 7), the actuator 1 is caused to rotate relative to the bolt operating member 11 against the actuator spring 7 because the bolt operating member 11 is constrained by the snap spring 56. For instance, when the knob is rotated about 90°, the actuator 1 engages with the third stopper pin 55. On the other hand, when the outer knob is rotated in the counterclockwise direction, the actuator 1 engages with the second stopper pin 13 through the second flange 6, the first stopper pin 9 and the engaging arm 12. In either case, the bolt operating member 11 remains stationary so that the dead bolt 47 also remains stationary.

In response to the unlocking signal OS, the engaging rod 16 is released in the manner described hereinbefore so that the engaging rod 16 is brought into engagement with the recess 8 of the actuator 1 under the force of the bias spring 18.

Figure 9:
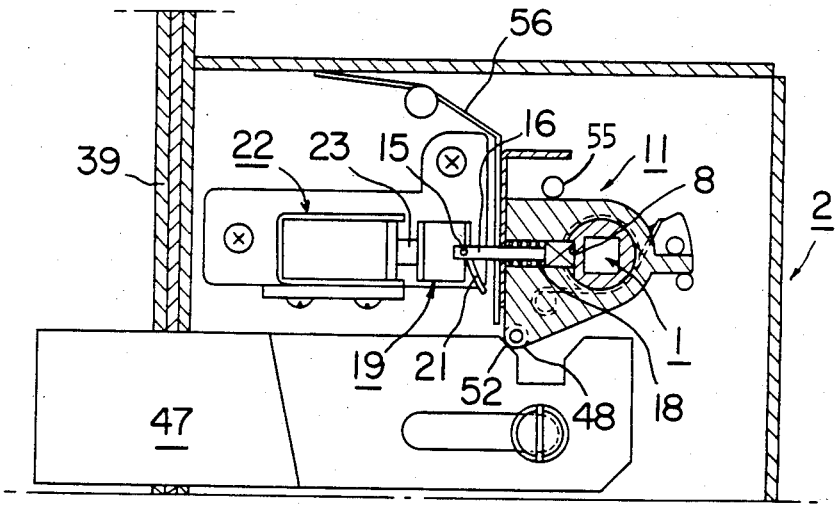
FIG. 9 is a top view, partly in section, illustrating only major parts when the electric lock is being unlocked.

When the outer knob or the like is rotated in the clockwise direction, the bolt operating member 11 which is securely joined to the actuator 1 is caused to rotate in the counterclockwise direction in FIG. 9. As a result, the dead bolt engaging pin 48 at one end of the bolt operating member 11 engages with the notch of the dead bolt 47 so that as the bolt operating member 11 is rotated, the dead bolt 47 is withdrawn into the lock box 2. For instance, when the bolt operating member 11 is rotated through 90°, the second flange 6 of the actuator 1 engages with the third stopper pin 55 and the dead bolt 47 is completely withdrawn into the lock box 2.

Figure 10:
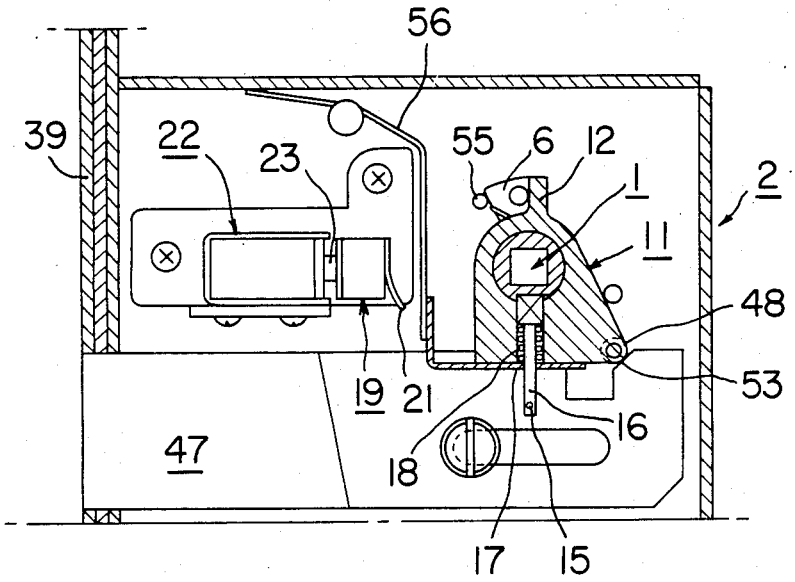
FIG. 10 is a view similar to FIG. 7 but illustrates that the electric lock is unlocked.

Simultaneously, the engaging pin 15 of the engaging rod 16 is displaced downwardly in FIG. 9 along the cam surface 21 of the cam member 19 and is released from the cam member 19 during the rotation of the bolt operating member 11. As a result, the plunger 23 and the cam member 19 are released so that they are withdrawn into the solenoid 22 under the force of the permanent magnet 25 which is no longer opposed, as shown in FIG. 10.

Thereafter, when the latch bolt operating knob is rotated in the clockwise or counterclockwise direction, the latch bolt operating cam 42 is rotated as is clear from FIG. 7 so that the latch bolt slider 29 is shifted to the right in FIG. 7. As a result, the head of the latch bolt is released from the door frame so that the door can be opened.

After one has entered a room, the dead bolt operating thumb-turn or the like is rotated in the clockwise direction. Then, the bolt operating member 11 which is joined to the actuator 1 is rotated in the clockwise direction in FIG. 10 so that the engaging pin 15 of the engaging rod is brought into engagement with one end of the cam surface 21 of the cam member 19 which has been returned to the locking position. Thereafter, the engaging rod 16 is displaced away from the recess 8 of the actuator 1 in a manner substantially similar to that described above so that the electric lock is locked as shown in FIG. 7. Simultaneously, the dead bolt 47 extends beyond the front panel 39 and engages with the strike hole.

Figure 11:
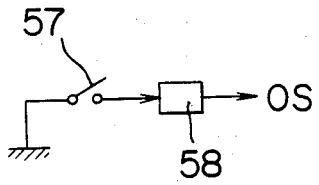
FIG. 11 is a block diagram of an unlocking signal generating circuit.

When one leaves a room, an unlocking button (not shown) disposed adjacent to the thumb-turn is operated so that an unlocking switch 57 is closed as shown in FIG. 11 so that an output signal is applied to a second monostable multivibrator 58. The output pulse derived from the second multivibrator 58 is applied as the unlocking signal OS to the positive voltage application unit 44 (See FIG. 4). Then the engaging rod 16 is displaced to the position as shown in FIG. 9 so that it become possible to operate the dead bolt by rotating the thumb-turn.

Figure 12:
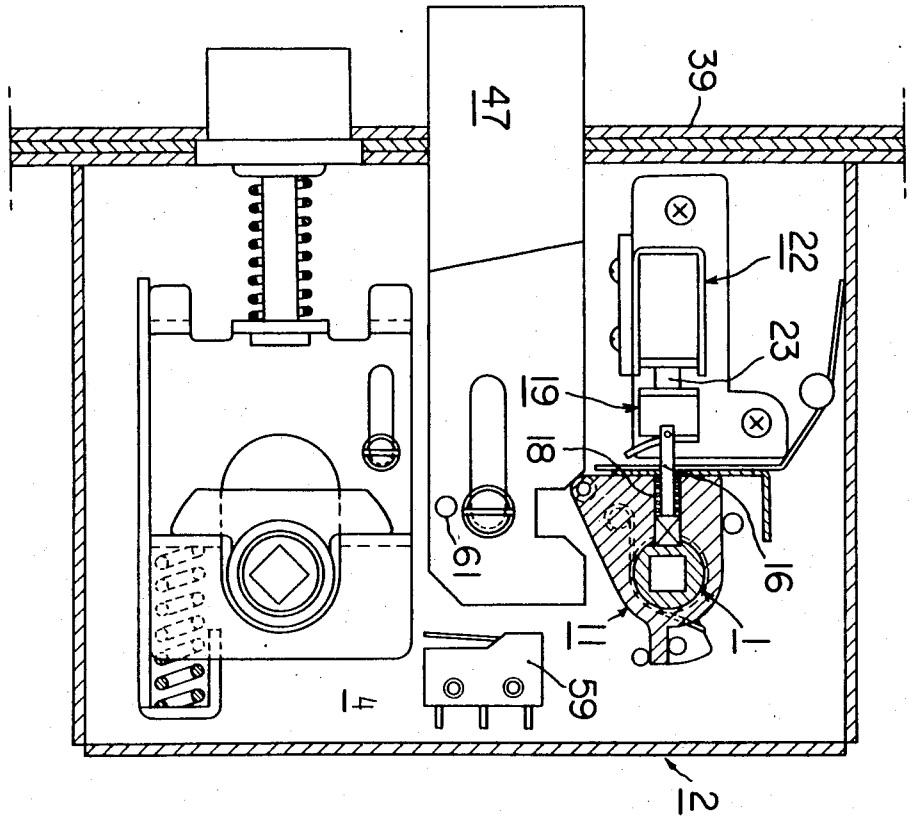
FIG. 12 is a top view, partly in section, of a third embodiment of the present invention.
Figure 13:
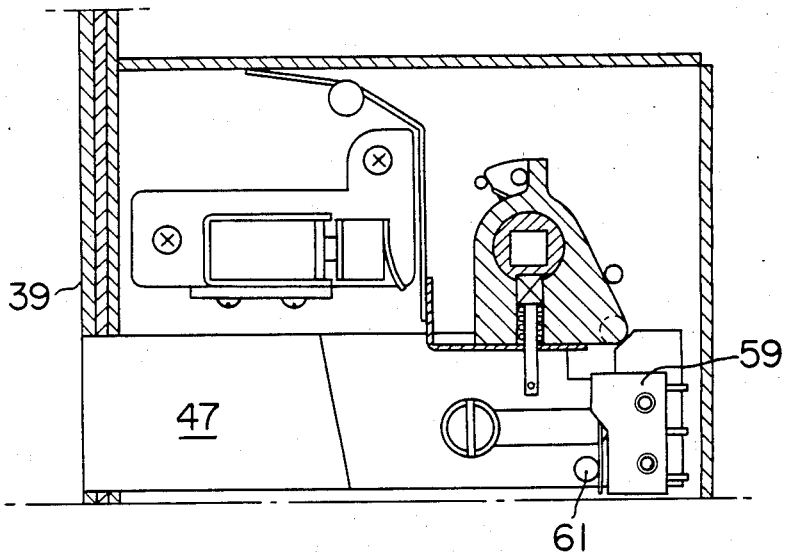
FIG. 13 is a top view, partly in section, only illustrating major parts when the electric lock is unlocked.
Figure 14:
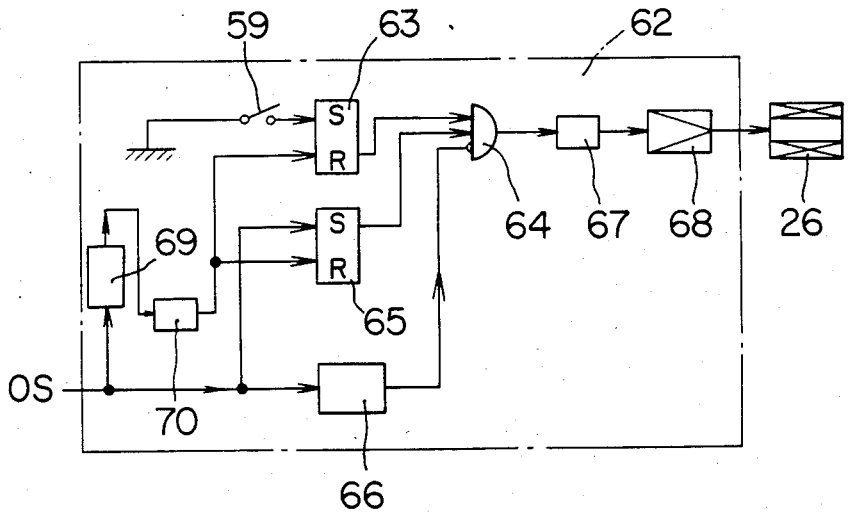
FIG. 14 is a block diagram of a reverse voltage application unit.

Third Embodiment, FIGS. 12–14

A third embodiment as shown in FIG. 12 is substantially similar to the second embodiment described above with reference to FIGS. 7–11 except that a normally open microswitch 59 is disposed on the second side plate 4, in such a way that the microswitch 59 will not interfere with the dead bolt 47; and a switch actuating pin 61 which engages with an actuator of the microswitch 59 is extended from the dead bolt 47 so that the microswitch 59 is closed by the switch actuating pin 61 when the electric lock is unlocked as shown in FIG. 13. Therefore, the arrangement of other parts will not be described in the third embodiment.

In the third embodiment of the present invention, when the engaging rod 16 engages with the recess 8 of the actuator 1 in response to an unlocking signal, the electric lock is re-locked automatically independently of an outer unlocking member.

That is, in the unlocked state wherein the engaging rod 16 is brought into engagement with the recess 8 of the actuator 1 as shown in FIG. 12, the engaging rod 16 cannot be returned by the attracting force of the permanent magnet of the solenoid 22. Therefore, as long as the bolt operating member 11 is not rotated, the engaging rod 16 remains at a stable position.

It is very rare, but it may happen one out of hundreds of cases that after the electric lock is unlocked as shown in FIG. 12 by inserting a magnetic card into a card reader, one does not operate the outer unlocking member or one does not enter a room because one recalls something which must be done before one enters the room. Furthermore it may be considered that after the unlocking switch 57 has been closed (See FIG. 11), one suddenly recalls something which must be done before he leaves so that one does not open the door. In these cases, the unlocked state is maintained in a stable manner as shown in FIG. 12 so that there arises a safety problem that a third person may enter the room.

In the third embodiment, therefore, when the bolt operating member 11 is not operated a predetermined time after the unlocking signal is generated, a reverse voltage application unit 62 (See FIG. 14) applies a reversed voltage (that is, a voltage whose polarity is opposite to that of the voltage applied when the electric lock is opened) to the electromagnetic coil 26 of the solenoid 22. As a result, the magnetic flux produced by the coil 26 is superposed over that produced by the permanent magnet so that the engaging rod 16 is attracted in the locking direction by a strong attracting force. Therefore, the engaging rod 16 is maintained at the locking position in a stable manner by the permanent magnet 25.

FIG. 14 shows the construction of the reverse voltage application unit 62.

That is, the output signal from the microswitch 59 is applied to the set input terminal of a first set-reset flip-flop 63 and a negative output signal derived from the flip-flop 63 is applied to an inhibit circuit 64. The unlocking signal OS is applied to the set input terminal of a second flip-flop 65 and a negative output signal derived from the flip-flop 65 is also applied to the inhibit circuit 64. The unlocking signal OS is also applied through a first timer 66 to the inhibit input terminal of the inhibit circuit 64. The first timer 66 is a memory device of the type which delivers the output signal for, for instance, 10 seconds after the unlocking signal OS has been received. For instance, the first timer 66 may comprise a monostable multivibrator.

The output signal of the inhibit circuit 64 is applied through a third monostable multivibrator 67 and a second amplifier 68 to the electromagnetic coil 26. The second amplifier 68 amplifies the output signal from the third monostable multivibrator 67 in such a way that the magnetic flux produced by the electromagnetic coil 26 has the same direction as the magnetic flux produced by the permanent magnet.

Meanwhile, the unlocking signal OS is applied to a second timer 69 whose operation time is slightly longer than that of the first timer 66 and the output signal from the second timer 69 is applied to the reset input terminals of the first and second flip-flops 63 and 65 through a fourth monostable multivibrator 70 which is triggered in response to the disappearance of a signal. The microswitch 59 is disposed in the lock box 2 in such a way that when the dead bolt is retracted into the lock box 2, the microswitch 59 is closed as shown in FIGS. 12 and 13.

In response to the unlocking signal OS, the second flip-flop 65 stores it in terms of generating an affirmative signal. After the unlocking signal OS is generated, the inhibit circuit 64 is closed by the first timer 66 for, for instance, 10 seconds and when the bolt operating member 11 is operated to close the microswitch 59 during the operation of the first timer 66 (See FIG. 13), the first flip-flop 63 generates an affirmative signal so that the inhibit circuit 64 remains closed.

On the other hand, when the microswitch 59 is not closed even after the operation of the first timer 66; that is, for instance 10 seconds have elapsed after the generation of the unlocking signal OS, the inhibit circuit 64 delivers the output signal so that the third monostable multivibrator 67 is actuated. While the third monostable multivibrator 67 is energized, a voltage with the polarity opposite to that of the voltage applied to the electromagnetic coil 26 of the solenoid when the electric door is to be unlocked is applied to the coil 26 so that the magnetic flux has a direction which is the same as the direction of the magnetic flux produced by the permanent magnet. As a result, the attracting force of the electromagnetic coil 26 is superposed on the attracting force of the permanent magnet 25. The strong superposed attracting force is exerted on the engaging rod 16, which remains in the unlocking state as shown in FIG. 12, through the plunger 23 and the cam member 19 so that the engaging member 16 is forced to return to the locking state (See FIG. 7) against the bias spring 18. When the second timer 69 is disabled, the fourth monostable multivibrator 70 delivers the reset signal so that the flip-flops 63 and 65 are reset. In the third embodiment, the microswitch 59 is closed when the dead bolt 47 is completely withdrawn from the front panel 39 as shown in FIGS. 12 and 13, but it is to be understood that lever or cam means which operate in unison with the bolt operating member 11 may be used so that the microswitch 59 is closed when the bolt operating member 11 is rotated through a predetermined angle.

As described above, according to the present invention, the actuator which is connected to the outer unlocking member and the bolt operating member for unlocking the electric lock are connected to each other or disconnected from each other by the displacement of the engaging rod which is biased so as to connect the bolt operating member to the actuator. Furthermore, there is provided a solenoid of the type having a permanent magnet and an electromagnetic coil which controls the magnetic flux of the permanent magnet. When the electric lock is locked, the engaging rod magnetically remains at a predetermined position determined only by the magnetic flux of the permanent magnet so that the bolt operating member remains stationary. When the electric lock is unlocked, power in the form of pulses is applied to the electromagnetic coil so that the magnetic force exerted by the permanent magnet may be temporarily opposed. Therefore the engaging rod is released and displaced under the mechanical force to the engaging position and remains in the engaging position in a stable manner. The engagement between the engaging pin and the cam member when the bolt operating member is rotated is utilized so as to return the engaging rod to the locking state under the mechanical force of the cam surface. Therefore, one unlocking and locking operation can be controlled by one pulse so that as compared with the conventional electric locks, the power required for operating the electric lock in accordance with the present invention can be considerably reduced. As a result, the present invention can provide an electric lock which can be operated by only the power supplied from a battery-power supply. So far it has been impossible to operate electric locks with such a power supply consisting of a battery or batteries. Therefore, the wiring of a power supply line can be eliminated so that the wide use of highly safe electric locks may be enhanced.

When the electric locks in accordance with the present invention are installed in a hotel or the like, all the electric locks can be simultaneously unlocked in the case of an emergency.

Furthermore, according to the present invention, after the electric lock has been unlocked, it is automatically and electromagnetically locked again without operating the bolt operating member so that even when one does not enter a room after the electric door is unlocked, a third person is inhibited from entering the room.

What is claimed is:

1. An electric lock comprising (a) an actuator rotatably supported by a lock box, integrally joined to an outer unlocking member and having a recess formed at the outer peripheral surface thereof;

(b) a bolt operating member rotatably fitted over said actuator;

(c) an engaging rod guided in the direction perpendicular to the axis of rotation of said actuator by said bolt operating member and having an engaging pin extended from one end thereof which is extended beyond said bolt operating member, and which is biased in the direction in which the other end thereof engages with said recess of said actuator;

(d) a solenoid having a permanent magnet for attracting a plunger and an electromagnetic coil connected to said permanent magnet to control the magnetic flux of said permanent magnet;

(e) a cam member having a cam surface formed at one end thereof which engages with said engaging pin when said bolt operating member is rotated to lock said electric lock so that the engaging rod is forced to move in the direction opposite to the direction in which said engaging bolt is biased, and whose other end is connected to said plunger of said solenoid; and (f) a voltage application unit which responds to an unlocking signal so as to cause a current to flow temporarily through said electromagnetic coil in such a way that the flux produced by said electromagnetic coil cancels the magnetic flux produced by said permanent magnet.

2. An electric lock as set forth in claim 1 wherein the magnetic attracting force of said permanent magnet which is exerted on said engaging rod engaged with said recess of said actuator when the electric lock is unlocked is set weaker than the biasing force exerted on said engaging rod.

3. An electric lock as set forth in claim 1 wherein said cam member is so supported that said cam surface at said one end thereof can swing toward the direction in which is displaced said plunger of said solenoid and the other end thereof can engage with the head of said plunger.

4. An electric lock as set forth in claim 1 wherein said cam member is securely fixed to the head of said plunger.

5. An electric lock comprising (f) a positive voltage application unit which responds to an unlocking signal so as to cause a current to flow temporarily through said electromagnetic coil in such a way that the flux produced by said electromagnetic coil cancels the magnetic flux produced by said permanent magnet; and (g) a reverse voltage application unit for causing a current to flow temporarily through said electromagnetic coil in such a way that the direction of magnetic flux produced by said electromagnetic coil is the same as the direction of magnetic flux produced by said permanent magnet when said bolt operating member is not operated within a predetermined time interval after said unlocking signal has been generated.

6. An electric lock as set forth in claim 5 wherein the magnetic attracting force of said permanent magnet which is exerted on said engaging rod engaged with said recess of said actuator when said electric lock is unlocked is set smaller than the biasing force exerted on said engaging rod.

7. An electric lock as set forth in claim 6 wherein during the energization of said reverse voltage application unit, the superimposed magnetic attracting forces of said permanent magnet and said electromagnetic coil which are exerted on said engaging rod engaged with said recess of said actuator is set greater than the biasing force exerted on said engaging rod.

8. An electric lock as set forth in claim 5 wherein said cam member is so supported that said cam surface at said one end thereof can be swung toward the direction in which the plunger of said solenoid is displaced and the other end thereof is connected to the head of said plunger.

9. An electric lock as set forth in claim 5 wherein said cam member is securely fixed to the head of said plunger.

10. An electric lock comprising a lock box having first and second substantially (a) an actuator rotatably supported by a lock box, integrally joined to an outer unlocking member and having a recess formed at the outer peripheral surface thereof, (b) a bolt operating member rotatably fitted over said actuator, (c) an engaging rod guided in the direction perpendicular to the axis of rotation of said actuator by said bolt operating member and having an engaging pin extended from one end thereof which is extended beyond said bolt operating member, and which is biased in the direction in which the other end thereof engages with said recess of said actuator;

(d) a solenoid having a permanent magnet for attracting a plunger and an electromagnetic coil connected to said permanent magnet so as to control the magnetic flux of said permanent magnet;

(e) a cam member having a cam surface formed at one end thereof which engages with said engaging pin when said bolt operating member is rotated to lock said electric lock so that the engaging rod is forced to move in the direction opposite to the direction in which said engaging rod is biased, and whose other end is connected to said plunger of said solenoid; parallel spaced side plates, and a front panel located therebetween;

a bolt member slidingly located within said lock box and extending through said front panel;

an actuator supported between said first and second side plates for rotation about an axis and integrally joined to an outer unlocking member, said actuator having a recess formed in the outer peripheral surface thereof;

a bolt operating member rotatably fitted over said actuator and engaging said bolt member, said bolt operating member having a guide hole therein extending substantially perpendicular to the axis of rotation of said actuator;

a solenoid including a permanent magnet, a plunger and an electromagnetic coil, said permanent magnet urging said plunger in a given direction, energization of said electromagnetic coil urging said plunger in the opposite direction when a voltage having a first polarity is applied thereto and in said given direction when a voltage having a second polarity is applied thereto;

an engaging rod having one end slidably fitting within the guide hole of said bolt operating member and insertable into the recess in said actuator, said engaging rod having an engaging pin extending from the other end thereof;

a cam member having a cam surface formed at one end thereof for engaging said engaging pin, the other end of said cam member being connected to the plunger of said solenoid, said engaging rod being translated in said given direction away from said recess by the force exerted by said permanent magnet and in said opposite direction into said recess when said electromagnetic coil is energized by a voltage having said first polarity, whereby, when said engaging rod engages said recess, rotation of said actuator rotates said bolt operating member to withdraw said bolt member into said lock box; and means for energizing the electromagnetic coil of said solenoid.

11. An electric lock as set forth in claim 10 wherein said bolt member is part of a latch bolt operating mechanism.

12. An electric lock as set forth in claim 10 wherein said bolt member is a dead bolt.

13. An electric lock as set forth in claim 10 wherein said engaging rod is provided with resilient means for urging said rod in said opposite direction into the recess in said actuator, the force exerted by said resilient means in said opposite direction being less than that exerted by said permanent magnet in said given direction.

14. An electric lock as set forth in claim 13 wherein said means for energizing the electromagnetic coil of said solenoid comprises a positive voltage application unit, said positive voltage application unit generating a voltage pulse having said first polarity in response to an unlocking signal.

15. An electric lock as set forth in claim 10 wherein said means for energizing the electromagnetic coil of said solenoid comprises a positive voltage application unit, said positive voltage application unit generating a voltage pulse having said first polarity in response to an unlocking signal.

16. An electric lock as set forth in claim 15 wherein said means for energizing the electromagnetic coil of said solenoid further comprises a reverse voltage application unit, said reverse voltage application unit generating a voltage pulse having said second polarity when said bolt operating member is not operated within a predetermined time interval after said unlocking signal has been generated.

* * * * *